United States Patent [19]

Avery

[11] Patent Number: 4,604,766

[45] Date of Patent: Aug. 12, 1986

[54] TILE CLEANING DEVICE FOR REMOVING CALCIUM BUILD-UP IN POOLS

[76] Inventor: Dennis Avery, 3328 Del Paso Blvd., Sacramento, Calif. 95815

[21] Appl. No.: 742,562

[22] Filed: Jun. 7, 1985

[51] Int. Cl.[4] ..... E04H 3/20; A46B 13/04

[52] U.S. Cl. ..... 15/50 C; 15/1.7; 15/21 E; 15/181; 15/198

[58] Field of Search ..... 15/1.7, 49 R, 49 C, 15/50 R, 50 C, 98, 21 E; 51/180

[56] References Cited

U.S. PATENT DOCUMENTS

| | | | |
|---|---|---|---|
| 3,562,832 | 2/1971 | Rickard | 15/21 E X |
| 4,193,228 | 3/1980 | Bowler | 15/1.7 X |
| 4,312,090 | 1/1982 | Durcan | 15/53 A |
| 4,324,015 | 4/1982 | Head | 15/49 C |

FOREIGN PATENT DOCUMENTS

| | | | |
|---|---|---|---|
| 2138194 | 3/1973 | Fed. Rep. of Germany | 15/49 C |

*Primary Examiner*—Edward L. Roberts
*Attorney, Agent, or Firm*—Leonard Bloom

[57] ABSTRACT

A tile cleaning device for removing calcium build-up which occurs substantially at and above a liquid level in a pool or the like which includes a wheeled frame adapted to be placed on a ledge surrounding the pool which is driven to cause the frame to move away from the pool edge, a brush attached to the frame and driven by a motor, the brush extending within the pool and adapted to abut against tile forming a pool wall so that the tension of the frame moving away from the pool provides pressure against the brush for cleaning the tile. Additional pressure can be brought to bear against the tile by providing an additional wheel with adjustment to alter the configuration of the frame relative to the pool edge so as to change the angle of attack of the brush, and a source for providing water upon the brush-tile interface is provided not only to lubricate the interface, but also to wash away calcium deposits that are stricken off the tile.

16 Claims, 8 Drawing Figures

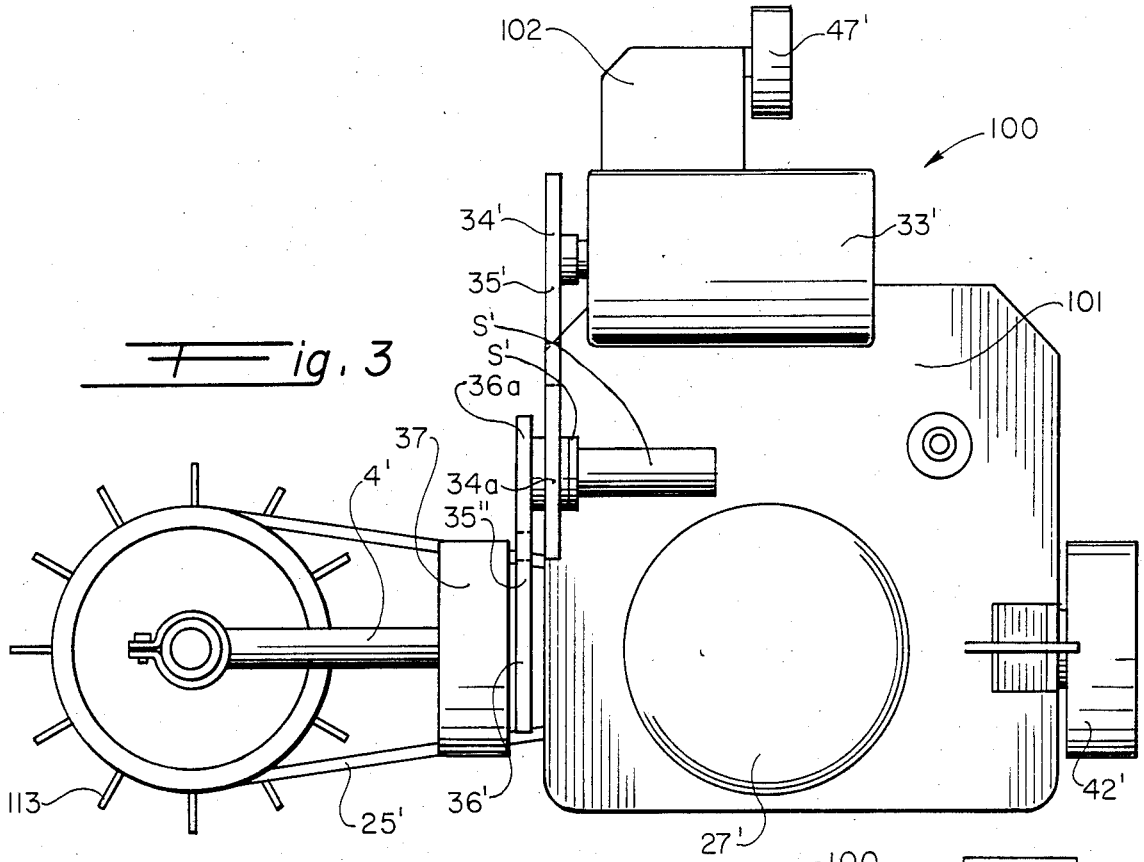
Fig. 3
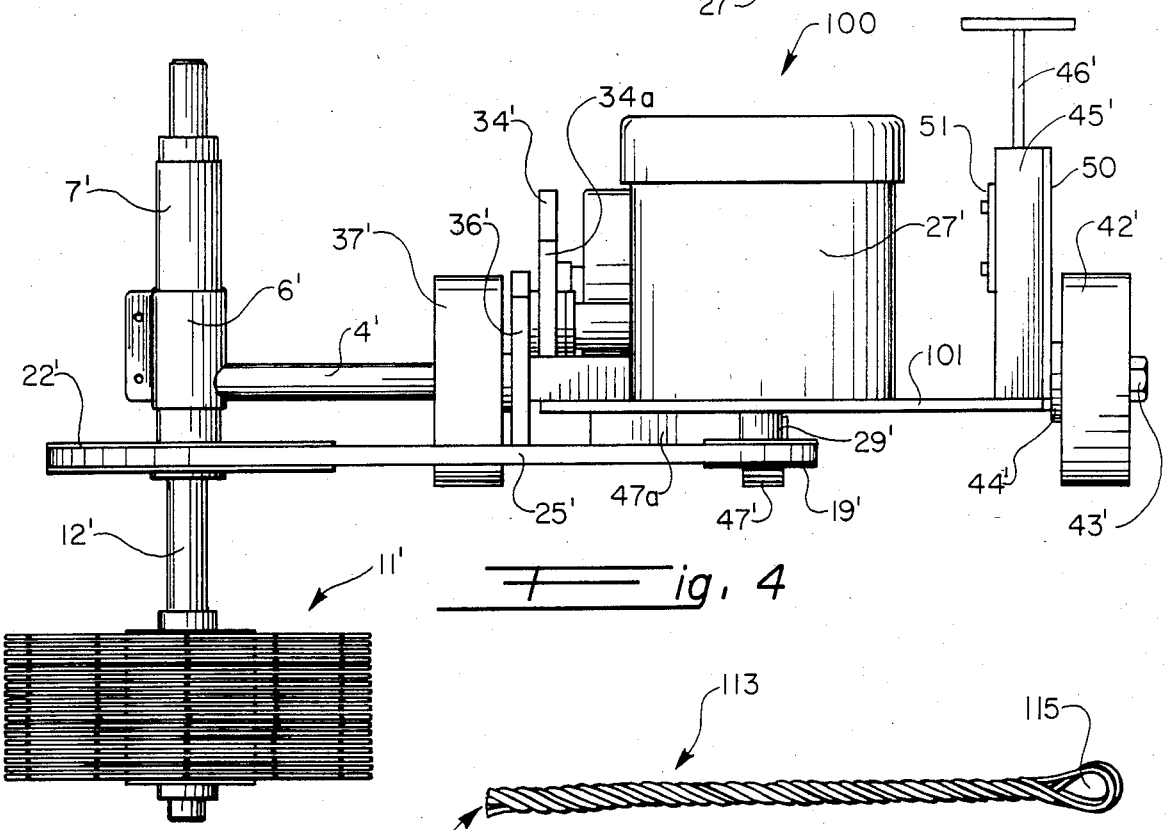
Fig. 4
Fig. 8

TILE CLEANING DEVICE FOR REMOVING CALCIUM BUILD-UP IN POOLS

BACKGROUND OF THE INVENTION

This invention relates generally to devices for cleaning tile that is disposed at or above the water line in swimming pools or the like.

Many water sources which are used to fill swimming pools and the like contain a plurality of minerals which are disposed within the pool. By continual evaporation and lapping of water against the side faces of the pool, a gradual build-up of calcium and other mineral deposits occur which mar the aesthetic qualities of the tile placed thereon.

To date, no readily available automated tool exists for cleaning the built-up calcium deposits in a facile manner, and the traditional techniques of manually removing the calcium deposits have been protracted arduous tasks, not relished by many people.

The following patents reflect the state of the art of which applicant is aware, in so far as these patents appear germane to the patent process.

U.S. Pat. No. 2,646,889, Dulak
U.S. Pat. No. 3,078,998, Blumenfeld
U.S. Pat. No. 3,108,298, Gelinas
U.S. Pat. No. 4,193,228, Bowler
U.S. Pat. No. 4,312,090, Durcan
U.S. Pat. No. 2,138,194 Ritter (Germany)
U.S. Pat. No. 3,344,454 Mikalson
U.S. Pat. No. 1,466,315 Thorsen
U.S. Pat. No. 4,324,105 Head Of these references, the patent to Bowler appears to be of great interest since he teaches the use of a water driven tool which rotatably drives a brush by means of the water pressure and a turbine so that the tiles along the topmost portion of a pool can be cleaned.

The patent to Dulak teaches the use of a swimming pool cleaning device in which wall portions of the pool as shown in FIG. 1 are capable of being cleaned by means of a comparatively complicated machine.

The remaining references show the state of the art further.

By way of contrast, the instant application is directed to and claims a cleaning device for removing calcium build-up which occurs substantially at and above a liquid level in a pool or the like that, once set up, can be allowed to operate automatically without substantial adjustments or manipulations of the machine to efficiently and effectively remove the built-up calcium along the inner upper peripheral wall of the pool. Since differing pools have ledges of varying slopes extending away from the pool itself, various instrumentalities are provided for controlling the angulation of a carrying frame relative to the ledge which not only direct the cleaning device in a prescribed manner, but also alters the amount of pressure exerted upon the tile face itself.

SUMMARY AND OBJECTS OF THE INVENTION

Accordingly, this invention has as an object the provision of a device for removing calcium build-up and the like which occurs substantially at and above a liquid level in a pool or the like.

It is yet a further object of this invention to provide a device of the character described above which has a plurality of means for controlling the device and altering the pressure exerted by a cleaning brush against a tile face as well as altering the direction of the device as it rims the pool.

It is yet a further object of this invention to provide a device of the character described above which is extremely safe to use and which, when once initialized, can traverse around the pool periphery with substantially no modifications in the adjustments.

It is still a further object of this invention to provide a device of the character described above which substantially reduces the amount of time required to clean the calcium deposits off of the pool tile when contrasted with the prior art.

These and other objects will be made manifest when considering the following detailed specification taken in conjunction with the appended drawing figures in which there has been provided a tile cleaning device for removing calcium build-up which occurs substantially at and above a liquid level in a pool or the like which includes a frame instrumentality, a brush instrumentality extending from the frame and oriented to address the tile, and a pressure instrumentality carried on the frame for urging the brush in striking relationship against the tile with an instrumentality to vary the force, the frame is supported on a ledge surrounding the pool by wheel instrumentalities, and the frame itself carries a source of power and a source of liquid which provides a flushing action along the interface between the brush and the tile for lubrication and removal of the striken calcium deposits.

BRIEF DESCRIPTION OF THE DRAWING FIGURES

FIG. 3 is a top plan view of FIG. 4.

FIG. 4 is a front view of a second form of the invention.

FIG. 8 is a side view of a second brush.

BRIEF DESCRIPTION OF THE PREFERRED EMBODIMENT

Figure 1:
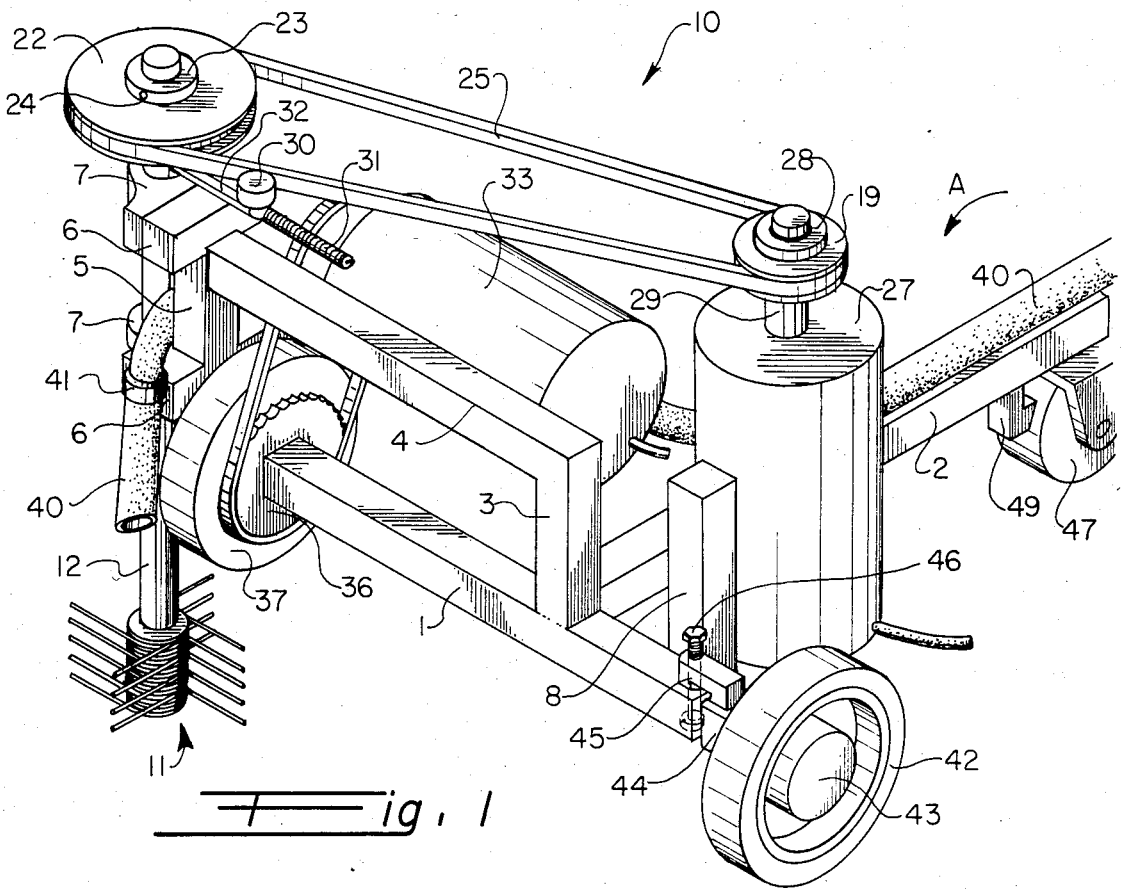
FIG. 1 is a perspective view of a preferred form of the invention.

Referring to the drawings now, wherein like reference numerals refer to like parts throughout the various drawing figures, reference numeral 10 is directed to a preferred form of the cleaning device for removing calcium according to the present invention.

Figure 2:
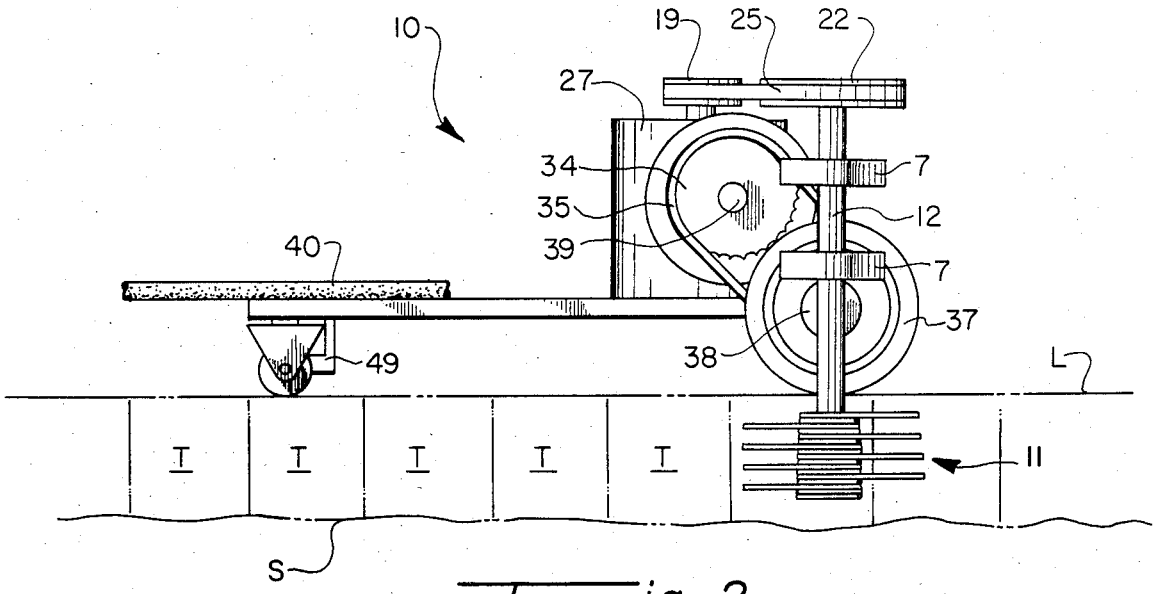
FIG. 2 is a side view thereof.

The device 10 as best seen in FIGS. 1 and 2 includes a frame of substantially T-shaped configuration in which a leading portion 1 of the frame has disposed intermediate its ends a tail 2 extending rearwardly. Proximate the intersection of frame members 1 and 2 an upwardly extending support rod 3 is provided having a laterally extending bar 4 parallel to leading portion frame member 1 adapted to extend substantially beyond the length of an end of leading portion 1 and terminating in an I-shaped brush holder having a vertical portion 5 and top and bottom portions 6 extending horizontally therefrom which serve to support upper and lower pillow blocks 7.

A brush shaft 12 extends through the upper and lower pillow blocks 7 and is capable of vertical adjustment by means to be defined hereinafter.

Figure 5:
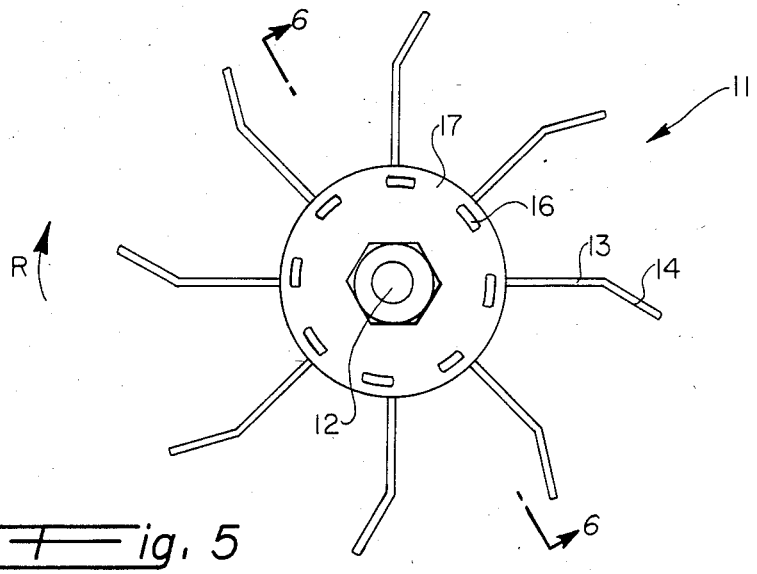
FIG. 5 is a top plan view of the brush in a preferred form.
Figure 6:
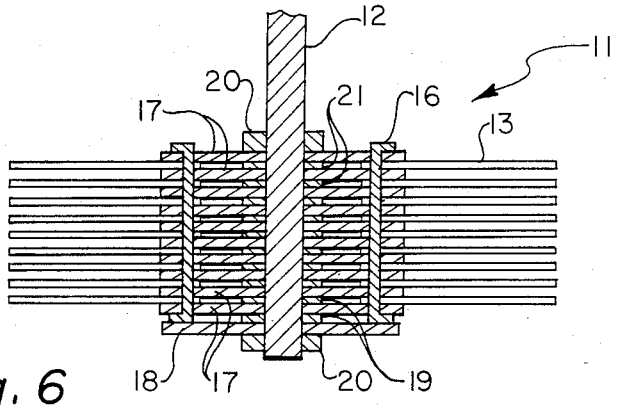
FIG. 6 is a sectional view taken along lines 6—6 of FIG. 5.
Figure 7:
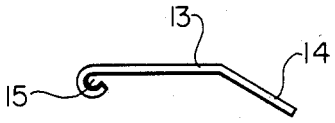
FIG. 7 is a top plan view of a single brush element according to the instant application.

The brush shaft 12 has at its lowermost portion a plurality of fingers which are best shown in FIGS. 5, 6, 7, and 8 and it is to be noted that the fingers are preferably formed from non-ferrous metal so as to not leave unwanted stains on the tile upon impact. Each finger is provided with a linear portion 13 and at one extremity a hook type loop 15 adapted to be fastened to a brush support mechanism, the extremity remote from the loop 15 having an angled terminus 14. FIG. 5 is a top plan view showing the preferred direction of rotation R of the device for impacting against tile, in such a manner that the calcium deposits carried on the tile are fractured therefrom and washed away in a manner to be described shortly. FIG. 6 is a sectional view in which the plurality of fingers are supported by vertical rods 16 having outwardly bent terminal portions, the loop 15 of each of the fingers in overlying relationship with the vertical rod 16. The fingers come in a plurality of sets, each set being horizontally spaced or stacked from a successive set, by means of a plurality of interposed apertured plates 17; a top plan view of one can be seen in FIG. 5. The plates are provided with suitable apertures for slidable insertion therein of the vertical rod 16 and the bent ends of the rod 16 engage a top surface of the uppermost apertured plate. The plates 17 are relatively spaced one from the other not only by the plurality of resilient fingers, but also by centrally disposed washers 21 disposed between the successive plates and surrounding the brush shaft 12. The bottommost extremity of the brush is provided with a non-foraminous plate 18, having only a central aperture for admission therethrough of the brush shaft 12, and the plate 18 is affixed to the brush shaft by means of a lower nut 20 threadably disposed upon the brush shaft. A top nut 20 is similarly threaded thereon, so that by tightening the upper and lower nuts relative to each other, the brushes are held in a firm manner. In a preferred form of the invention, each set of brushes 11 includes eight metallic fingers as shown in FIG. 5.

FIG. 8 reflects a second form of brush finger 113 formed from braided wire. Preferably, three strands of wire are first bent into a "U" shaped configuration and then braided or twisted so that the bight portion of the "U" shaped wire now forms a loop 115. The end of the finger remote from the loop 115 can be trimmed so that this end 114 is even.

The brush shaft 12 is capable of vertical re-orientation by means of its disposition within the pillow blocks 7, and a topmost extremity of the brush shaft is provided with a pulley 22 having a locking collar 23 disposed atop thereof, provided with a locking set screw 24 in a manner that is well known in the art. Thus, whereas the pulley 22 is provided in a fixed horizontal plane, the brush shaft 12 can more upwardly and downwardly to accomodate pools of different geometrical configurations by adjusting collar 23 and pillow blocks 7. As shown in FIG. 1, a hose 40 is provided and tethered to the lowermost pillow block support 6 by means of band 41 which is affixed to the pillow block support, and the hose is oriented to provide debris flushing and lubrication along the interface between the fingers 14 as it contacts the tile T in a pool. The hose 40 is directed rearward of the frame and trails the machine in operation with a second portion of the hose 40 shown on top of the frame tail portion 2 in FIG. 1.

The brush 11 is driven by means of a motor 27 disposed upon a vertical support 8 operatively connected to a face of the frame member leading portion 1, and the motor 27 includes an output shaft 29 having a pulley 19 disposed on a top extremity thereof placed in substantially the same horizontal plane as the brush pulley 22, the motor pulley 19 affixed on shaft 29 by means of locking collar 28 similar to the above discussed collar 23. A belt 25 extends between pulleys 22 and 19, for driving the brush shaft in a manner well known in the art, and the belt 25 is provided with a tension idler 30 by means of spring 31 which is at one end is affixed to a drive motor 33 and the other end to the upper pillow block support 6 through a rod 32. Thus, the apropriate tension is maintained on the brush drive belt 25 at all times.

The frame includes a plurality of downwardly depending wheels which support the frame and allow the frame to travel along the pool edge L shown in FIG. 2, and at least one driven wheel 37 is provided proximate to the brush as shown in FIGS. 1 and 2. With this arrangement, a single driven wheel provides a natural tendency for the frame to rotate in an arc A about a rear wheel 47 thereby providing a pressure force against which the brush 11 does work. Specifically, the driven wheel 37 includes a hub 38 on one side proximate to the brush 11, and on the other side a sprocket 36 adapted to be driven by means of a chain 35 which is operatively connected to a further sprocket 34 mounted on a shaft 39 which extends outwardly from a gear reduction motor 33. It is contemplated that in most operations, the driven wheel should not move the frame and therefore the brush less than three inches per minute, nor more than ten feet per minutes, based on the composition of the fingers and tile as well as the pressure limitations against the tile. Similarly, the metal fingers work most effectively at a constant rate, and it is not contemplated that the brush 11 will rotate in excess of 3,000 RPM or less than 250 RPM, the metal fingers being made out of a non-ferrous or carbon steel material.

An additional technique for altering the pressure of the brush against the tile is provided, and FIG. 1 denotes a means for elevating a further wheel 42 which is outward or away from the brush, but is substantially coaxial with the driven wheel 37. A hub 43 communicates with a hub supporting block 44 which has on a topface thereof an inverted U-shaped bracket 45, a portion of the bracket 45 overlying frame member 1 and having a threaded bore therethrough through which a carriage bolt passes having an outer threaded periphery extending through the frame 1 whereby rotation of the carriage bolt 46 alters the elevation of the wheel 42. A clearance is provided between the frame member 1 and 44. Thus the frame can be canted for further pressure modification.

A further means for altering the pressure against the brush is provided, and to this end, a caster wheel 47 is pivotally disposed on the trailing portion 2 of the frame through a swivel block 48 with the means for additionally providing pressure on the brush 11 bearing the reference numeral 49. It is contemplated that the additional means for providing pressure may be a friction brake or a spring which tends to cause caster wheel 47 to resist rotation, therefore providing a turning moment even greater than that which occurs by having a single driven wheel 37. In this manner, additional control of the brush can be effected.

As shown in FIG. 2, the frame is adapted to ride on the ledge L surrounding a pool having a water surface S and a plurality of tiles T along an upper marginal portion thereof.

FIGS. 3 and 4 shown an alternative embodiment to that which is shown in FIGS. 1 and 2. Similar parts are correlated by the use of the notation for time (').

Essentially, the tile cleaner of FIGS. 3 and 4 include a base plate 101 of substantially rectangular configuration having rabbited leading corners and trunkated rear corners and a rearwardly extending plate 102 that supports a trailing wheel 47 prime. As shown in FIG. 4, the trailing wheel 47 prime is supported on a bottom face of plate 102 by means of an axle holder 47A.

The most salient difference between FIGS. 1 and 2 and FIGS. 3 and 4 is that the motor drive occurs below the support plate 101 with a belt 25 prime extending from a motor 27 prime which has an output shaft 29 prime extending through the plate 101, communicating with a drive pulley sheave 19 prime. The belt 25 prime straddles a wheel 37 prime immediately adjacent to the pool, and communicates with a brush drive pulley 22 prime so as to drive the brush shaft 12 prime similar to FIGS. 1 and 2. The brush of FIG. 8 is shown ganged together as 11 prime, and the brush shaft 12 prime is capable of vertical translation for adjustment by means of a clamp 6 prime variably constricting a shaft sleeve 7 prime allowing displacement of the brush. The clamp 6 prime is supported to the base plate 101 by means of a supporting arm for prime.

The drive wheel 37 prime is driven by a motor 33 prime carried on a rearward portion of the supporting plate 101. In this embodiment, a sprocket 34 prime emanating from the motor 33 prime communicates with a sprocket 36 prime which drives the wheel 37 prime through an external gear reduction means configured as a pair of sprockets 34A and 36A of relatively different dimension. That is, the sprocket 36A is substantially smaller than sprocket 34A for mechanical advantage. Sprockets 34 prime and 34A are coupled by means of a chain 35 prime whereas sprockets 36 prime and 36A are coupled by another chain 35 double prime. The two sprockets 34A and 36A are coupled on a sleave S carried on a shaft S prime supported on the base plate 101.

A means for altering the relationship of the outward wheel 42 prime with respect to the base plate 101 is provided. As shown in FIG. 4, the outward wheel 42 prime is supported by means of a plate connected to an axle holder 44 prime, the axle (not shown) fixes the wheel through a nut 43 prime. The plate 50 is connected to sliding plate 51 on an opposed side of housing 45 prime by means of a pair of bolts. A threaded screw 46 prime having a T shaped handle is fixed to the housing by a bushing, and a threaded nut extending between plates 50 and 51 allows the threaded shaft 46 prime to alter the elevation of the wheel 42 prime when the threaded shaft 46 prime is rotated. Thus, a threaded nut passes up and down the length of threaded shaft 46 prime and, being connected to plates 50 and 51 causes vertical translation of the wheel 42 prime.

Having thus described the invention, it should be appreciated that in use and operation, the wheeled frame is continuously urged outwardly away from the lip of the pool so that work is performed against the tile by means of the brush, whose rotation fractures the calcium deposits off of the tile. The hose 40 provides liquid along the interface between the brush and the tile so as to not only lubricate the brush area, reducing heat, but also to wash away the calcium which has been stricken off the tile. In addition, each of the motors carried on the frame 33, 33', 27 and 27' is provided with its own source of electrical output by means of a power cable, and in conjunction with the hose 40 which trails behind the frame, provides an additional resistive weight which accentuates and enhances the drive wheels' predilection toward turning away from the pool.

Having thus described the invention, it should be apparent that numerous structural modifications are contemplated as being a part of this invention as set forth hereinabove and as defined hereinbelow by the claims.

I claim:

1. A tile cleaning device for removing calcium buildup from tile which occurs substantially at and above a liquid level in a pool or the like comprising, in combination:

a wheeled frame means, placed adjacent a ledge surrounding the pool, brush means extending from said frame means oriented to address the tile, and pressure means on said frame means for urging said brush means in striking relationship against the tile including a single driven wheel proximate the pool ledge whereby said driven wheel tends to drive away from the pool ledge providing at least a portion of said pressure means on said brush means whereby calcium deposits and the like are fractured off the tile.

2. The device of claim 1 including flushing means provided on said frame means oriented to apply liquid along the brush tile interface.

3. The device of claim 1 wherein said brush means includes a plurality of fingers extending radially from a central area.

4. The device of claim 3 wherein said brush means includes fingers formed from strands of wire doubled over and braided such that one end forms a loop, each said loop supported on said brush means by rods extending through a plurality of said looped ends, said rods fixed to a brush shaft by means of spaced plates within said fingers are sandwiched.

5. The device of claim 1 wherein said wheel pressure means includes another further removed from the ledge than said driven wheel provided with elevational means to alter the angulation of said frame means relative to the ledge and said other wheel and thereby provide additional pressure means on said brush means against the tile.

6. The device of claim 1 wherein said brush means includes a plurality of fingers extending radially from a central area, said fingers having angled terminal positions to contact the tile.

7. The device of claim 1 wherein said pressure means includes at least one wheel trailing said driven wheel having a brake means thereon to increase the tendency of said wheeled frame to rotate from the ledge.

8. The device of claim 7 wherein said driven wheel is powered by a gear reduced motor carried on said frame.

9. The device of claim 8 wherein said brush means is powered by a second motor through a spring tensioned belt.

10. The device of claim 1 wherein said brush means includes plural sets of fingers having spaced plates interposed between said sets, said fingers looped around rods extending through said plates, said plates fixed to a brush shaft driven by a motor.

11. A tile cleaning device for removing calcium buildup from tile which occurs substantially at and above a liquid level in a pool or the like, comprising in combination: a frame means supported on wheels adapted to circumscribe a pool about its associated ledge, brush means supported by said frame means oriented to contact the pool tile, and means to automatically power one of said wheels independent of other wheels which carry the frame, said one powered wheel oriented to provide a turning moment about said frame such that said frame circumscribes the pool along its associated ledge and the turning moment is resisted by said brush means, whereby pressure is applied to said brush means by the turning moment against the tile and causes said frame to circumscribe the pool.

12. The device of claim 11 wherein said brush means is rotatably driven.

13. The device of claim 11 including flushing means provided on said frame means oriented to apply liquid along the brush-tile interface.

14. The device of claim 11 wherein said brush means includes a plurality of fingers extending radially from a central area, said fingers having angled terminal positions to contact the tile.

15. The device of claim 11 wherein said brush means includes plural sets of fingers having spacing plates interposed between said sets, said fingers looped around rods extending through said plates, said plates fixed to a brush shaft driven by a motor.

16. A tile cleaning device for removing calcium buildup from tile which occurs substantially at and above a liquid level in a pool or the like comprising in combination: a frame means supported on wheels adapted to circumscribe a pool about its associated ledge, brush means supported by said frame means oriented to contact the pool tile, and means to automatically power one of said wheels independent of other wheels which carry the frame, said one powered wheel oriented to provide a turning moment about said frame such that said frame circumscribes the pool along its associated ledge and the turning moment is resisted by said brush means, whereby pressure is applied to said brush means by the turning moment against the tile and causes said frame to circumscribe the pool, said frame embodied as a plate having a rearwardly extending portion upon which a trailing wheel is provided, said brush means formed as a plurality of radially extending fingers having a looped end and formed from braided wire, a belt means underlying said frame connecting a motor to said brush means, and means for angulating an outboard wheel of said frame including first and second spaced plates interconnected by means of bolts, said bolts further supporting a nut thereon, and a threaded shaft extending through said nut and fixed to a frame housing, said frame housing causing vertical translation of said spaced plates upon rotation of said threaded shaft, said spaced plates connected to the outboard wheel to alter the angulation thereof.

* * * * *